US006425460B2

(12) United States Patent
Schuster

(10) Patent No.: US 6,425,460 B2
(45) Date of Patent: Jul. 30, 2002

(54) METHOD FOR TEMPORARILY OPERATING AN ELEVATOR IN RESPONSE TO USER TRANSMITTED PROGRAM

(75) Inventor: Kilian Schuster, Ballwil (CH)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/808,305

(22) Filed: Mar. 14, 2001

(30) Foreign Application Priority Data

Mar. 20, 2000 (EP) ..... 00810234

(51) Int. Cl.[7] ..... B66B 1/34
(52) U.S. Cl. ..... 187/247; 187/391
(58) Field of Search ..... 187/247, 391, 187/392, 394, 393, 380, 382, 384

(56) References Cited

U.S. PATENT DOCUMENTS

| | | | | | |
|---|---|---|---|---|---|
| 3,973,648 | A | * | 8/1976 | Hummert et al. | 187/29 R |
| 5,159,163 | A | * | 10/1992 | Bahjat et al. | 187/133 |
| 5,200,583 | A | * | 4/1993 | Kupersmith et al. | 187/126 |
| 5,736,692 | A | * | 4/1998 | Lumme et al. | 187/247 |
| 5,749,443 | A | * | 5/1998 | Romao | 187/384 |
| 5,817,994 | A | * | 10/1998 | Fried et al. | 187/391 |
| 6,269,911 | B1 | * | 8/2001 | Richter | 187/289 |
| 6,330,935 | B1 | * | 12/2001 | Systermans | 187/391 |

FOREIGN PATENT DOCUMENTS

| | | | | | |
|---|---|---|---|---|---|
| EP | 0 540 984 | | | 10/1992 | |
| EP | 0 731 050 | | | 3/1996 | |
| JP | 08229760 | A | * | 9/1993 | 187/247 |
| JP | 06239548 | A | * | 8/1994 | 187/391 |
| JP | 06271208 | A | * | 9/1994 | 187/247 |

* cited by examiner

*Primary Examiner*—Jonathan Salata
(74) *Attorney, Agent, or Firm*—MacMillan, Sobanski & Todd, LLC

(57) ABSTRACT

An elevator user creates on a user terminal an individual user program, that is adapted to his needs, for operating the elevator. The user terminal can include a keypad for selecting commands and entering values, and a screen for displaying the command sequence. Depending upon authorization, the user can access the entire command set or only certain commands. The user program is transmitted to a terminal of an elevator control by wireless communication and proceeds to a program control which adds to the user program data required for execution and stores it in a memory. A task manager of the control program initiates the execution of the user program by an interpreter that interprets the program step by step. In the case of elevator-specific instructions such as, for example, travel commands or door opening commands, the interpreter calls up an interface that initiates the further execution by an elevator control.

16 Claims, 2 Drawing Sheets

METHOD FOR TEMPORARILY OPERATING AN ELEVATOR IN RESPONSE TO USER TRANSMITTED PROGRAM

BACKGROUND OF THE INVENTION

The present invention relates to a method for operating an elevator, with which a user of the elevator communicates to the elevator via a human-machine interface an order that the elevator executes.

To operate an elevator it is usual to have arranged on each floor, or in the elevator car, an operating panel that serves as a human-machine interface. Provided on the operating panel is a call button for each destination floor. On a panel with a ten-digit keypad, commands for multi-digit floors are entered by combinations of keys. For the elevator control, the target floor selected by the user is a parameter in a permanently programmed sequence of the elevator control for execution of the travel order. The elevator control executes the travel order according to an internal program in which, for example, the car load is read, coincident trips are taken into account, the doors are closed after a certain time, the acceleration, traveling speed and deceleration are determined, and the door is held open for a certain time at the destination floor. For the program, the starting floor and destination floor serve simply as parameters.

A disadvantage of this known elevator control method is that the program is defined at the time when the elevator is developed, after which it can no longer be changed, at least by the user.

SUMMARY OF THE INVENTION

The present invention provides a solution to avoiding the disadvantages of the known elevator control method by specifying a method by means of which the functioning of an elevator can be determined when it is used.

The advantages achieved by the present invention are that for the user of the elevator an individual interface can be made in which the orders to be executed by the elevator can be programmed on an external operating terminal with keypad and screen. The user can use the elevator according to his needs. He can, for example, specify different door opening times, which are longer or shorter than the standard. In this way, certain users or groups of users, such as cleaning or maintenance personnel, can be provided with different command sets. A further advantage is that there is great freedom for the user in defining the functioning of the elevator without intervention in the basic functions of the elevator, such as door functions, being necessary. A further advantage is that certain functioning modes such as, for example, car cleaning, or evacuation, can be standardized independent of the elevator installation.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
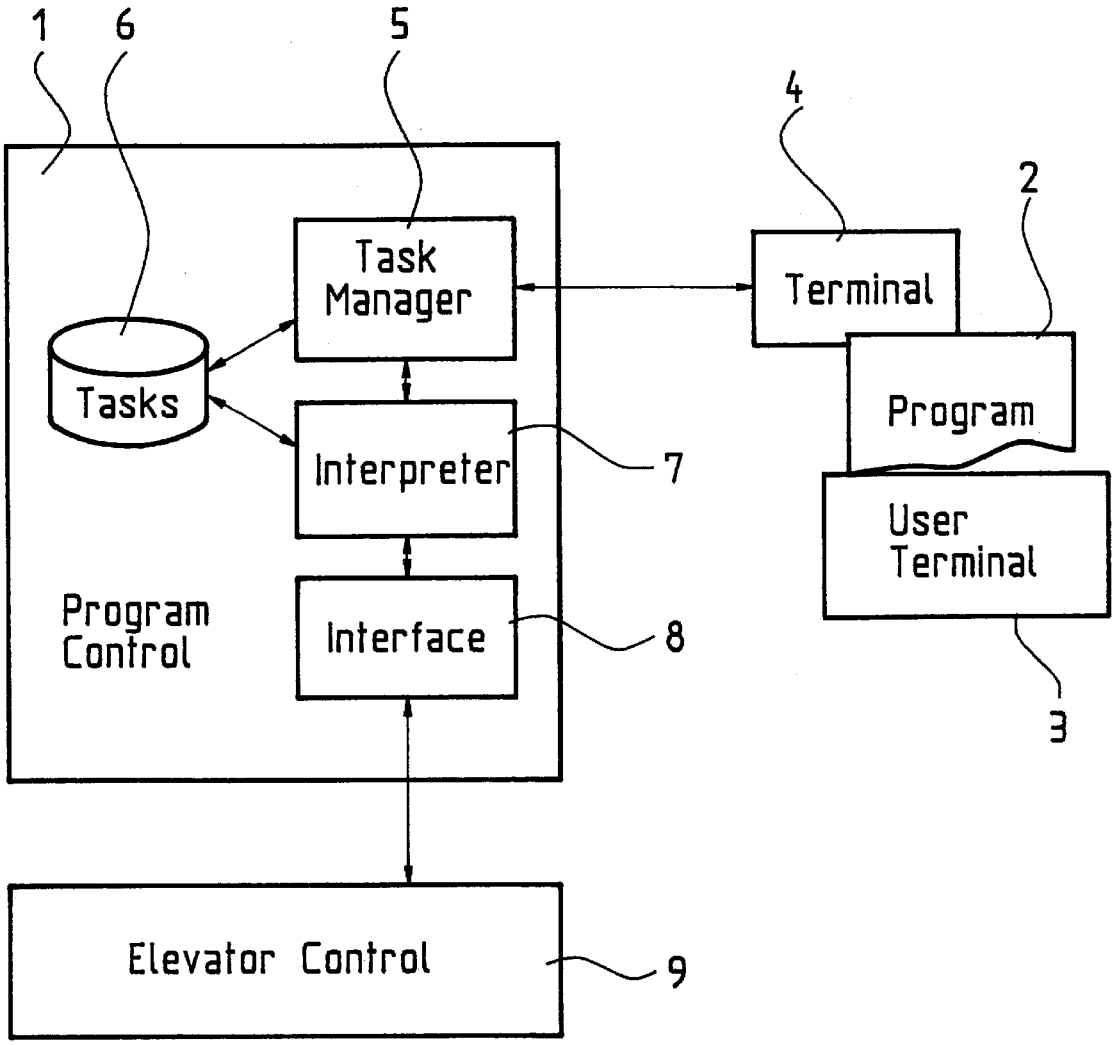
FIG. 1 is a block diagram of a control method for the execution and control of an elevator user program according to the present invention.

FIG. 1 shows a block diagram of a program control 1 for the execution and control of a user program 2. An elevator user creates on a user terminal 3 his individual user program 2, which is adapted to his needs, for operating the elevator. The program 2 can be written at a time independent of execution of the order, and at a place independent of the elevator installation. To write and execute the program 2, the user terminal 3 is similar to the commonly available personal digital assistant (PDA) devices having a keypad, a screen, means of storage, means of calculation, at least one interface, and a transmitter/receiver like that of, for example, a mobile telephone. In the user terminal 3 the entire command set, for example, can be stored. Depending on the access authorization defined for the user in, for example, the user terminal 3, the user can access the entire command set, or only certain commands. The user terminal 3 can, for example, also contain an exchangeable chip card on which at least the user program 2 is stored.

The user program 2 is transmitted, for example by wireless communication, in encrypted or unencrypted form, to a terminal 4 of which, for example, one is arranged on each floor of an elevator installation. The user program 2 can also be stored in the terminal 4 and need only be activated by the respective user. From the terminal 4 the user program 2 proceeds to the program control 1 with its task manager 5 which adds to the user programs 2 of all the terminals 4 data necessary for execution and stores them in a memory 6. The task manager 5 initiates the execution of executable user programs by means of an interpreter 7 that interprets the executable programs 2 step by step. In the case of elevator-specific instructions such as, for example, travel commands or door-opening commands, the interpreter 7 calls up an interface 8 that initiates the further execution by an elevator control 9. After complete execution of a selected one of the user programs 2, the selected executable user program is deleted and, if necessary, the user is informed of the conclusion of his user program 2.

In essence, the user program 2 can contain data about the user, the place and time of issue of the order, travel commands, reservations of space in the elevator car, and door opening and closing commands. The user program 2 can also contain trip-specific parameters as, for example, travel speed, acceleration and deceleration values, load, special trip, or information concerning information and display elements, etc. The respective command set available in each case forms the operating interface for the user.

Examples of the user program 2 for operating an elevator are described below. As a first example, for a trip from floor A to floor B, the user program 2 can consist of the following sequence [1]:

01 share_priority 50
02 goto A
03 open 2s
04 reserve 1m2
05 goto B
06 open 2s
07 release 1m2

In step "01", the order to be executed is weighted with a priority that indicates that individual actions of other orders with priorities less than or equal to a value "50" will be interrupted or shared respectively. This rule serves mainly to coordinate special requirements, as explained further below. For normal trips as described above, it should be endeavored to have orders that are uniform in respect of sequence. In step "02", the elevator car is ordered to floor "A". With step "03", the command is issued to open the landing and car doors for "2" seconds. In step "04", space is reserved in the car for one person. With step "05", the command to travel to floor "B" is issued. With step "06", the command is again issued to open the landing and car doors for "2" seconds. With step "07", the command sequence is concluded by the reserved space in the elevator car being released.

As a second example, for up-peak distribution trips the user program 2 can consist of the following sequence [2] with iteration. The command set can, for example, be made available only during certain times of day.

```
01 share_priority 100
02 goto 0
03 open 5s
04 reserve 5m2
05 for i=1 to 10 do
   goto i
   open 2s
   end
06 goto 0
07 open 5s
08 release 5m2
```

In step "01", the order to be executed is weighted with a priority that indicates that individual actions of other orders with priority less than or equal to "100" will be interrupted or shared respectively. In step "02", the elevator car is ordered to the main stop "0". With step "03", the command is issued to open the landing and car doors for "5" seconds. In step "04", space is reserved in the car for five persons. In step "05", an iteration is shown by means of which a travel command for floors 1 to 10 is issued, stating that the elevator car must stop at floors "1" to "10" and on each floor open the landing door and car door for "2" seconds. After this, with step "06" the elevator car is ordered to the main stop "0", and with step "07" the command is issued to open the landing door and car door for "5" seconds. With step "08", the command sequence is concluded by the reserved space in the elevator car being released.

For elevator car cleaning, the user program 2 can consist of the following sequence [3]. The user program 2 can, for example, be written by the building maintenance services and stored on a chip card, or directly in the user terminal 3 of the cleaning personnel, or in the terminal 4. When required, the car cleaning personnel then need only to activate the user program 2.

```
01 require_priority 30
02 close
03 goto 1
04 open 5s
05 wait pressed DTO
06 open 5s
07 wait 20s
```

In step "01", the order to be executed is weighted with a priority which indicates that other orders will be postponed until the car cleaning has been carried out. With step "02", the command is issued to close the landing door and car door. With step "03", the elevator car is ordered to floor "1", from which the car cleaning work is carried out. With step "04", the command is issued to open the landing door and car door for "5" seconds so that the car cleaning personnel can enter the elevator car. With step "05", the user program 2 is interrupted until, for example, on the screen of the user terminal 3, or on the car operating panel, a pushbutton "DTO" is actuated. With step "06", the command is then issued to open the landing and car doors for "5" seconds so that the car cleaning personnel can leave the elevator car. The command in step "07" is optional and provided in case cleaning work outside the elevator car is necessary. As an alternative, the landing door and car door can be kept open until the pushbutton "DTO" is actuated.

For evacuation trips in emergency situations the user program 2 can consist of the following sequence [4] for example:

```
01 require_priority 250
02 close
03 goto 0
04 open
```

In step "01" the order to be executed is weighted with a priority which indicates that other orders will be interrupted and their execution postponed. With step "02", the command is issued to close the landing door and car door. With step "03", the elevator car is ordered to the evacuation floor, and with step "04", the landing door and car door are opened.

For service and maintenance it is possible, for example, to make available an extended command set, or a command set based on another programming language. With these command sets user programs can be written by means of which, for example, the elevator cars can be ordered to certain positions in the hoistway, for example to adjust hoistway switches or to carry out maintenance work in the hoistway from the roof of the car. To check the drive, or slip, it is possible, for example, to use the program to specify certain speed curves for the trip.

On an elevator group with elevators having different rated loads, the program can be used to communicate to the control the load to be transported. The control then selects the elevator corresponding to the desired load.

On an elevator group with elevators of different speeds it is possible, for example, for VIP trips to use the program to request the elevator with the highest speed.

To avoid misuse it is possible to demand from the user a password, for example, or for VIP trips to take account of additional personal characteristics of the user.

The available command set for writing a user program can be adapted depending on the user and trip or transport. For maintenance personnel an extended command set is available. VIP persons have more commands available than normal users. Occupants of the upper floors of a multi-story building can be provided with commands to influence the travel speed. For hospital personnel a command set is available for passenger elevators or bed elevators. The command set can also be time-independent. For example, occupants of the higher-level floors can be provided in the morning with commands for nonstop travel down, and in the evening with commands for nonstop travel up. Since all travel and user data of an order are contained in the user program 2, the user program can also be used to keep account of the costs of usage. The respective user receives, for example, each month an invoice for the services provided.

Figure 2:
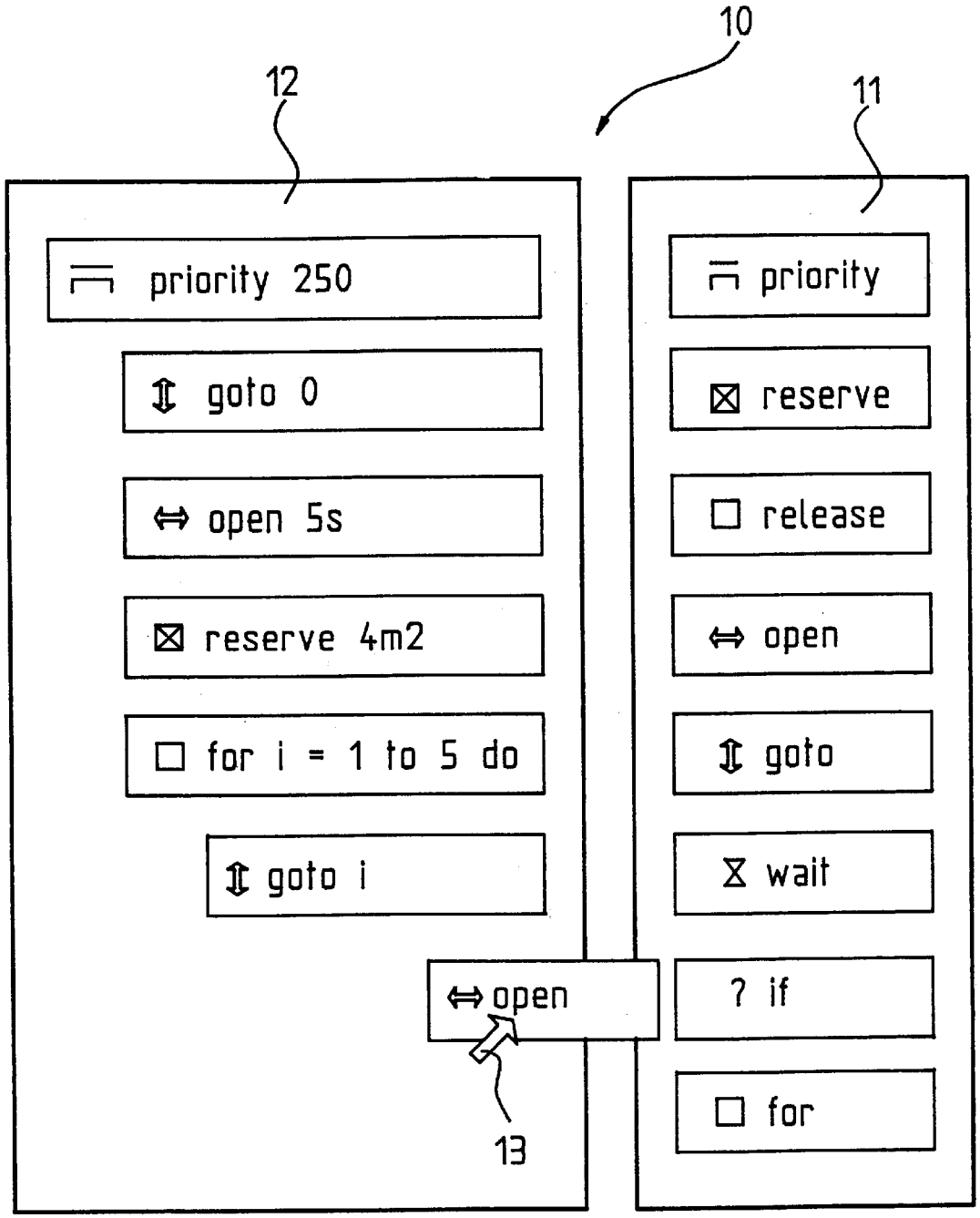
FIG. 2 is schematic view of the operating interface screen display of the user terminal shown in FIG. 1.

FIG. 2 shows an example of an operating interface display on a screen 10 of the user terminal 3. In a right-hand half 11 of the terminal screen 10 the available command set is shown, which is made up from text elements depending on the user. Thus, although ten commands are shown, more or less can be provided. Each text element representing a command can, for example, be copied to a left-hand half 12 of the screen 10 by means of a movable arrow marker 13 (cursor) and, if necessary, have added to it parameters such as, for example, the door opening time, the floor number, the priority value, space reservation in the car, etc. As an alternative, for example, the text element for the door opening time and/or the text element for space reservation can be provided with a preset parameter. The present floor and/or the destination floor can also be provided with parameters. The user can change the preset parameters according to his choice. After composition of the program in the left-hand half 12, which is easy for any user, the finished user program 2 is sent to the terminal 4.

If it is intended that the user program 2 which has been created shall be reused, it can be saved in a memory such as in the user terminal 3 or on a chip card (not shown), and called up automatically or with short commands. The way in which the individual text elements function is explained in more detail in the sequences [1], [2], [3], and [4] described above.

If users are not authorized or able to write individual user programs 2, the desired user program can be written on a remote user terminal and saved on a chip card. The chip card with the finished user program 2 can then be inserted into the user terminal 3 of the user without programming authorization, which terminal serves as an interface between the chip card and terminal 4.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for operating an elevator system in response to an operating order that is executable by a control of the elevator system comprising the steps of:

a. creating a user-specific operating order as a user program in response to commands entered by a user into a terminal of a human-machine interface;

b. transmitting the user program to a terminal connected to a program control for an elevator system in response to an input to the user terminal by the user; and c. executing the user program in the program control to operate the elevator system in accordance with the user-specific operating order.

2. The method according to claim 1 including limiting the types of commands available to the user based upon an access authorization of the user.

3. The method according to claim 1 including limiting the types of commands available to the user based upon at least one of a load to be transported, a traffic volume, and a time of day.

4. The method according to claim 1 including storing the user program in a memory associated with one of the user terminal and a chip card.

5. The method according to claim 1 including generating an account of travel costs from the user program.

6. The method according to claim 1 wherein the creating step is performed at a location remote from the elevator system.

7. The method according to claim 1 wherein the creating step is performed at a time that is prior to but independent of the transmitting and executing steps.

8. The method according to claim 1 wherein the user program includes data about at least one of the user, a location, a time of issuing the operating order, travel commands, reservations of space in an elevator car, door opening and closing commands, and trip-specific parameters.

9. The method according to claim 1 including providing the commands as combinable text elements.

10. A method for operating an elevator system in response to a user generated operating order that is executable by a control of the elevator system comprising the steps of:

a. creating a user-specific operating order as a user program in response to user selected commands;

b. transmitting the user program to an elevator program control for an elevator system when the user is ready to use the elevator system; and c. executing the user program with the program control to operate the elevator system in accordance with the user-specific operating order for a single use of the elevator system user.

11. The method according to claim 10 including prior to performing the executing step adding data to the user program necessary for execution.

12. The method according to claim 10 including subsequent to performing the executing step deleting the user program from the program control.

13. The method according to claim 10 including informing the user of conclusion of the user program after complete execution.

14. The method according to claim 10 including making available to the user selected ones of a plurality of commands based upon an access authorization of the user.

15. A method for operating an elevator system in response to a user created operating order that is executable by a control of the elevator of the elevator system comprising the steps of:

a. creating a user-specific operating order as a user program in response to a plurality of user commands entered into a terminal;

b. storing the user program;

c. selectively transmitting the user program to an elevator program control for an elevator system;

d. executing the user program with the program control to temporarily operate the elevator system in accordance with the user-specific operating order; and e. deleting the user program from the program control upon completion of said step d.

16. The method according to claim 15 wherein said steps a. and b. are performed utilizing a user terminal and said step c. is performed by wireless transmission.

* * * * *